US005261713A

United States Patent [19]

Fischbach

[11] Patent Number: 5,261,713

[45] Date of Patent: Nov. 16, 1993

[54] ELECTROMAGNETIC DOOR LOCK

[76] Inventor: Frederick F. Fischbach, 657 Liberty Point Dr., Ann Arbor, Mich. 48103

[21] Appl. No.: 956,394

[22] Filed: Oct. 5, 1992

Related U.S. Application Data

[63] Continuation-in-part of Ser. No. 901,581, Jun. 19, 1992.

[51] Int. Cl.[5] ..... E05C 19/16

[52] U.S. Cl. ..... 292/251.5; 292/DIG. 64

[58] Field of Search ..... 292/251.5, 144, 201, 292/DIG. 64, 92

[56] References Cited

U.S. PATENT DOCUMENTS

| | | | |
|---|---|---|---|
| 3,931,551 | 6/1976 | Holt | 317/151 |
| 4,257,631 | 3/1981 | Logan | 292/251.5 |
| 4,318,155 | 3/1982 | Thomas | 361/156 |
| 4,439,808 | 3/1984 | Gilliham | 361/144 |
| 4,516,114 | 5/1985 | Cook | 340/542 |
| 4,682,801 | 7/1987 | Cook | 292/251.5 |
| 4,840,411 | 6/1989 | Sowersby | 292/251.5 |
| 4,957,316 | 9/1990 | Frolov | 292/251.5 |
| 5,016,929 | 5/1991 | Frolov | 292/251.5 |

OTHER PUBLICATIONS

Securitron-Magnalock Advertisement Access Control Magazine Jan. 1990.

*Primary Examiner*—Richard E. Moore

*Attorney, Agent, or Firm*—James M. Deimen

[57] ABSTRACT

An electromagnetic door lock comprises in combination a convex armature plate and oblong magnet whereby the plate is flattened into full contact with the magnet when energized. De-energizing the magnet allows the plate to spring back to the convex shape and elastic means to instantly separate the armature from the magnet. One or more reed switches are located in cavities in the support bracket for the magnet. The reed switches are positioned to sense a substantial change in the leakage flux caused by an "air gap" between the armature and the magnet and thereby infer full locking or unlocking of the door lock.

18 Claims, 2 Drawing Sheets

ELECTROMAGNETIC DOOR LOCK

This is a continuation-in-part of copending application Ser. No. 07/901,581 filed on Jun. 19, 1992.

BACKGROUND OF THE INVENTION

The field of the invention pertains to electromagnetic door locks and, in particular, to improved means for sensing adequate locking of the door and means for better assuring release of the door upon collapse of the magnetic field.

The electromagnetic door locks of interest generally comprise oblong magnets constructed of a stacked plurality of "E" shaped magnet iron laminations within a thin case. Laminations are used to reduce the remanence to the lowest level possible. The center pole of the "E" is wrapped with multiple turns of magnet wire. The entire volume within the "E" and containing the wire is potted or sealed with a non-magnetic non-conductive plastic.

U.S. Pat. No. 4,682,801 illustrates such a door lock including its typical location on a door frame and the location of the complementary armature on the door. The armature typically comprises a flat piece of steel that when the door is fully closed preferably contacts or comes into very close proximity to the poles of the "E" to complete a magnetic circuit through the armature. Also illustrated is the electric circuitry for the electromagnet some of the circuitry being positioned at the end of the electromagnet. Typically, the electric circuitry shown is sealed or potted to prevent damage or premature deterioration of the circuit elements. As a result such door locks are extended in length at one end substantially beyond the electromagnet length and are asymmetric in appearance. Illustrative of this design is the Securitron-Magnalock advertisement in the January 1990 issue of Access Control Magazine.

Alternatively, the electric circuitry may be merely enclosed by a removable cover as illustrated in the DynaLock advertisement in the January 1990 issue of Doors & Hardware Magazine. Or the electromagnet case may be further extended at both ends to create a more symmetric appearance.

Residual magnetism drastically affects the time to release after the electric power is disconnected from the electromagnet. For many applications, in particular, emergency door exits, the lock should fully release to less than four pounds residual attractive force within a fraction of a second. To overcome quickly the residual magnetism both mechanical and electrical means have been employed. Plating applied to protect against corrosion of the magnet and armature serves as an "air gap" and therefore substantially counters the remanence of the magnet iron. Mechanically, an elastic grommet or spring is compressed between the armature and the electromagnet when engaged. With the collapse of the electromagnetic field, the grommet or spring urges the armature apart from the electromagnet, releasing the door. The rubber grommet or spring also acts to quiet or silence the lock when the door is closed with the lock energized.

Electrically, capacitor circuits have been employed to reverse the magnetic field upon de-energization of the electromagnet. Reversal of the magnetic field effectively overcomes the residual magnetism. U.S. Pat. No. 3,931,551 and U.S. Pat. No. 4,318,155 disclose such capacitor circuits.

Also electrically, and common in tractive electromagnets other than door locks, for example those employed lifting steel in junkyards, the electric current energizing the coil is simply reversed in polarity for a brief time to accomplish the removal of the residual magnetism. These devices are unacceptable for exit door locks since, for safety, exit doors must be unlocked immediately if there is loss of power to the lock.

With a view toward further improving the electromagnetic door lock technology above by making the release of the armature more positive and effective and to provide a more compact and symmetrical electromagnet, applicant has developed the following improvements.

SUMMARY OF THE INVENTION

The invention comprises improvements to decrease the release time of the armature from the electromagnet and to sense any gap between the armature and the electromagnet when the armature is energized without adding electric circuitry to the body of the electromagnet.

The armature only visually appears to be a flat plate affixed to a door and positioned to contact the poles of the electromagnet in turn affixed to the door frame. The armature actually is formed with a large radius curvature in the surface that contacts the electromagnet. The electromagnet coils, and iron core which may be laminated or cast, comprise the electromagnet body. The associated sensing circuitry that signals a gap between the armature and the electromagnet is located literally within the bracket that attaches the electromagnet to the door frame. The sensing circuitry includes a reed switch enclosed within the bracket just above the electromagnet. The reed switch is sensitive to the leakage flux above the electromagnet and armature, the leakage flux increasing with a decrease in gap between the electromagnet and the armature. The result is a particularly compact electromagnet structure and an improved release time for the armature and door.

The curvature of the armature in effect changes the effective location of the neutral "fiber" or neutral plane of the armature when under full magnetic load. The full force of the magnet straightens or flattens the armature to provide full contact of the armature against the electromagnet. Sudden collapse of the magnetic field when the electrical power is interrupted allows the armature to regain its relaxed shape by overcoming the residual magnetism in the magnetic circuit between the armature and the electromagnet. In the relaxed shape the rubber or spring "silencer" that urges the armature apart from the electromagnet can effectively fully separate the armature from the electromagnet. The result is a more positive and quicker separation of the armature from the electromagnet when the power to the electromagnet is cut off.

DESCRIPTION OF THE PREFERRED EMBODIMENTS

Figure 1:
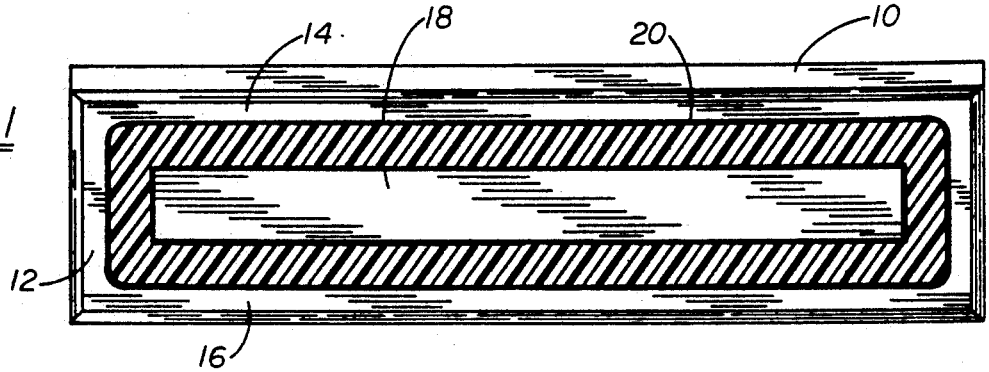
FIG. 1 is a front view of the new electromagnetic door lock.
Figure 2:
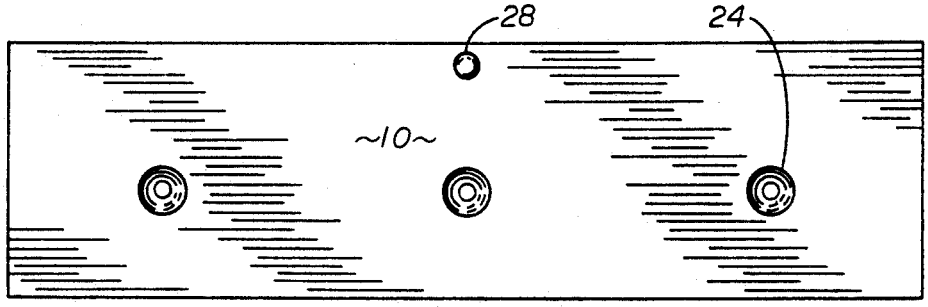
FIG. 2 is a back view of the lock.
Figure 3:
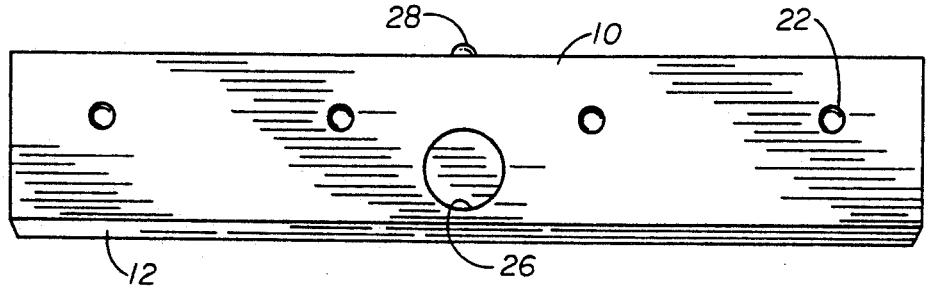
FIG. 3 is a top view of the lock.

Illustrated in FIGS. 1, 2 and 3 is the exterior view of the bracket 10 and electromagnet 12 assembled together. The upper 14 and lower 16 poles and center pole 18 are exposed to the front of the electromagnet and separated by an area 20 filled with plastic to cover the magnet coils therebehind. The top of the bracket 10 includes holes 22 for screws to attach to a door frame. The back of the bracket includes holes 24 for screws to attach the electromagnet 12 to the bracket 10. An additional port 26 in the bracket 10 is provided for the lead wires to the electromagnet. A light emitting diode 28 is provided to indicate that the door lock is energized and senses a nearly perfect magnetic bond.

Figure 4:
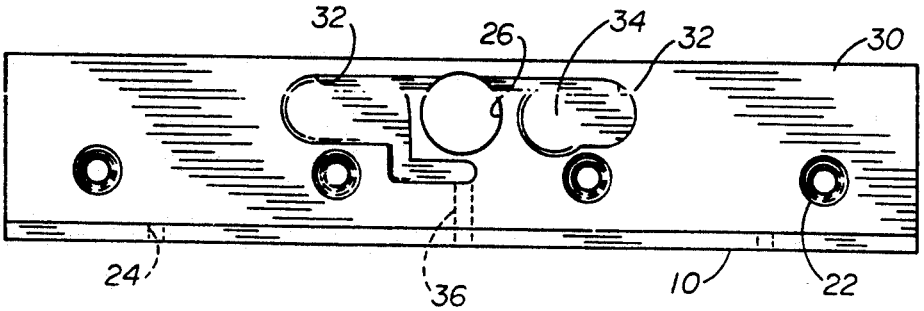
FIG. 4 is an underside view of the mounting bracket for the electromagnet.
Figure 7:
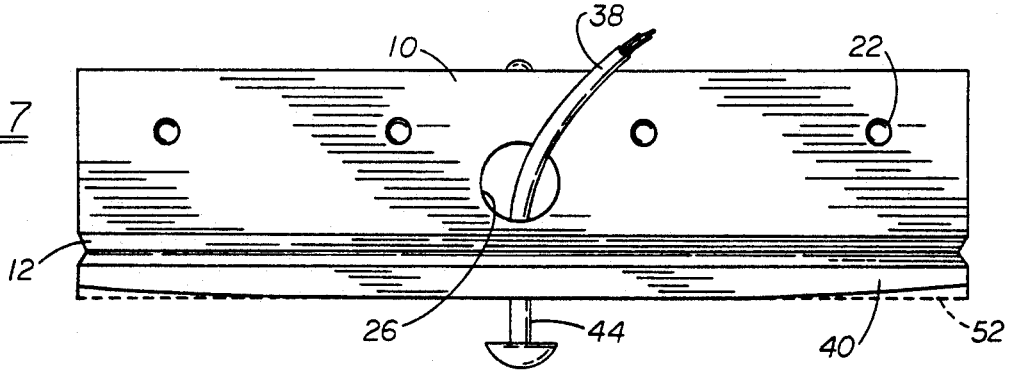
FIG. 7 is a top view of the bracket, electromagnet and armature assembled and in contact.

In FIG. 4 the bracket 10 comprises an aluminum "L" section having the relatively thick short side 30 of the "L" at the top. Milled into the short side 30 from underneath are one or more cavities 32 adapted and shaped to contain a plurality of solid state electric circuit elements including one or more reed switches 34 sensitive to the magnetic leakage flux above the electromagnet. A port 36 penetrates to the back of the bracket for the light emitting diode 28. In the preferred mode the thickness of the aluminum in the short side 30 is about one-quarter inches. Only the port 26 penetrates therethrough. The circuit elements within the cavities 32 are potted in place permanently including reed switches 34. When the bracket 10 is assembled to the electromagnet 12 the cavities 32 are completely covered and only the lead wires 38 as shown in FIG. 7 appear coming out of the port 26.

With a reed switch 34 positioned above and in close proximity to the electromagnet 12 and in such angular position (33 in FIG. 4) as to establish a lower limit on the magnetic leakage flux required to close the reed switch, any leakage flux level equal to or greater than the lower limit closes the switch thereby sensing by inference sufficient magnetic bond strength between electromagnet 12 and armature 40 to ensure adequate locking of the door. By means of its associated circuit shown in FIG. 4, closure of the switch 34 illuminates light emitting diode 28, indicating the door is locked.

Similarly, one or more other reed switches 34 may be placed in cavities 32 and employed to sense the required leakage flux level which by inference senses sufficient magnetic bond strength to ensure adequate locking of the door. The closure of one or more reed switches 34 as may be placed in one or more circuits indicates to a remote location or locations 31 that the door is adequately locked. One such simple circuit is shown in FIG. 4 including optional current limiting resistor 35 and protective diode 37.

Whilst the closure of a single throw—normally open reed switch or switches 34 is shown in FIG. 4 as the simplest embodiment, reed switches of double-throw or of single throw—normally closed configuration may be employed wherein opening of the switch provides indication of adequate door locking, or of non-adequate door locking. The reed switches 34 will sense as little as 0.004 inches of gap between the armature 40 and the magnet 12 depending on the switches selected.

The circuit containing the light emitting diode 28, and the other circuit or circuits providing remote indication are all independent and isolated electrically one from another, and each may be employed above, in any combination, or omitted entirely.

Figure 5:
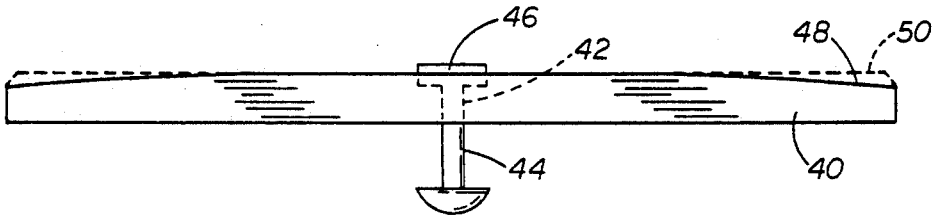
FIG. 5 is an exaggerated top view of the armature and retaining bolt.
Figure 6:
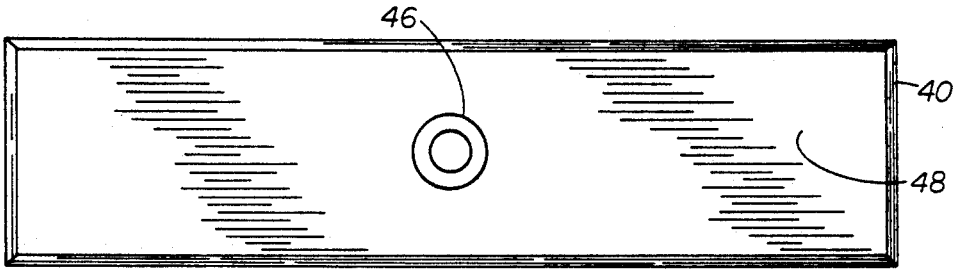
FIG. 6 is a face view of the armature.

In FIGS. 5 and 6 the armature 40 is illustrated. The armature 40 comprises a steel plate having a counterbored hole 42 for a flat headed cap screw 44. The cap screw 44 affixes the armature 40 to the door. An elastic washer 45 separates the armature 40 from the door permitting the armature to perfectly align with the magnet 12. Affixed to the flat head of the cap screw 44 is an elastic grommet 46 which extends beyond the face 48 of the armature 40.

Rather than being perfectly flat, the face 48 of the armature 40 is formed with a smooth convex curvature from end to end as indicated by the face surface 48 relative to the dashed outline 50. The curvature is preferably formed by attaching flat stock to an electromagnetic chuck with the complementary concave curvature and milling the face surface 48. In FIG. 5 the curvature is shown greatly exaggerated, the actual difference in thickness from the center to either end of the armature being only a few thousandths of an inch for one-half inch thick steel nine inches long.

Engagement of the armature 40 with the energized electromagnet 12 causes the armature to bend into full contact with the poles 14, 16 and 18. The result is substantial bending stress on the armature 40, a change in the location of the "neutral plane" or "fiber" in the armature and therefore substantial potential energy in mechanical form. This potential energy in the form of a loaded leaf spring is released when the electromagnet 12 is de-energized thereby countering the residual magnetism in the magnetic circuit by creating an almost instantaneous air gap as the armature 40 peels back from the electromagnet. With the armature 40 relaxed the squeezed grommet 46 can expand fully releasing the armature from the electromagnet 12. Thus, in summary the electromagnet 12 bends the armature 40 substantially flat as indicated by the dashed line 50 in FIG. 5. For an electromagnetic door lock of nominal 1200 pounds pull, the magnetic residual force drops to a neglible value in less than 0.1 second, thus the improvements are very advantageous for emergency exit doors.

In FIG. 7 the complete bracket 10, electromagnet 12 and armature 40 in contact therewith are shown from the top. The lead wires 38 to the electromagnet 12 extend from the port 26. As indicated by dashed line 52 the armature 40 is flexed into full contact with the electromagnet 12.

I claim:

1. An electromagnetic door lock comprising an electromagnet, an armature adapted to contact the electromagnet and complete a magnetic circuit when the door lock is locked, electromagnetic sensing means external to the electromagnet, said electromagnetic sensing means sensitive to the magnetic leakage flux external to the electromagnet and armature whereby the level of leakage flux sensed indicates a locked or unlocked condition of the lock.

2. The electromagnetic door lock of claim 1 including a bracket attached to the electromagnet, said sensing means mounted on the bracket in close proximity to the electromagnet.

3. The electromagnetic door lock of claim 2 including at least one cavity formed in the bracket, said sensing means being located in the cavity.

4. The electromagnetic door lock of claim 3 wherein the sensing means comprises at least one reed switch located in the cavity.

5. The electromagnetic door lock of claim 4 wherein two reed switches are symmetrically positioned in angular relationship to the center of the electromagnet.

6. An electromagnetic door lock comprising an oblong electromagnet having a surface for contacting an armature, said electromagnet having a frame formed of a single piece of cast magnetically permeable material;

an armature having a surface for contacting the electromagnet, wherein at least one of said surfaces is convex;

and additional means to form an "air-gap" between the surfaces to counter the remanence of the cast frame and armature.

7. The electromagnetic door lock of claim 6 wherein the additional means comprise plating on at least one of the surfaces.

8. The electromagnetic door lock of claim 6 wherein the additional means comprise elastic means located between the surfaces, said elastic means compressed when the armature fully contacts the electromagnet in locked condition.

9. An electromagnetic door lock comprising an oblong electromagnet having a surface for contacting an armature, said electromagnet having a frame formed of a single piece of cast magnetically permeable material, an armature having a surface for contacting the electromagnet, wherein at least on of said surfaces is convex, additional means to form an "air gap" between the surfaces to counter the remanence of the cast frame and armature.

electromagnetic sensing means external to the electromagnet, said electromagnetic sensing means sensitive to the magnetic leakage flux external to the electromagnet and armature whereby the level of leakage flux sensed indicates a locked or unlocked condition of the lock.

10. The electromagnetic door lock of claim 9 including a bracket attached to the electromagnet, said sensing means mounted on the bracket in close proximity to the electromagnet.

11. The electromagnetic door lock of claim 10 including at least one cavity formed in the bracket, said sensing means being located in the cavity.

12. The electromagnetic door lock of claim 11 wherein the sensing means comprises at least one reed switch located in the cavity.

13. The electromagnetic door lock of claim 11 wherein two reed switches are symmetrically positioned in angular relationship to the center of the electromagnet.

14. The electromagnetic door lock of claim 9 wherein the additional means comprise elastic means located between the surfaces, said elastic means compressed when the armature fully contacts the electromagnet in locked condition.

15. The electromagnetic door lock of claim 1 wherein the electromagnet includes a frame formed of a piece of cast magnetically permeable material.

16. The electromagnetic door lock of claim 15 wherein the cast frame is oblong in shape and symmetrical about a horizontal plane and a vertical plane.

17. The electromagnetic door lock of claim 15 including a bracket attachable to the electromagnet, at least one cavity formed in the bracket, said sensing means being located in the cavity.

18. The electromagnetic door lock of claim 16 including a bracket attachable to the electromagnet, at least one cavity formed in the bracket, said sensing means being symmetrically positioned about the vertical plane of symmetry.

* * * * *